US005886632A

United States Patent [19]

Shpater

[11] Patent Number: 5,886,632

[45] Date of Patent: Mar. 23, 1999

[54] PASSIVE INFRARED MOTION DETECTION CIRCUIT HAVING FOUR COMPARATORS

[76] Inventor: Pinhas Shpater, 795 Muir, #1004, Ville St. Laurent, Quebec, Canada, H4L 5H8

[21] Appl. No.: 967,039

[22] Filed: Nov. 10, 1997

[51] Int. Cl.[6] ..... G08B 13/00

[52] U.S. Cl. ..... 340/541; 340/567; 250/221; 250/342; 250/353

[58] Field of Search ..... 340/541, 567, 340/565, 555, 556, 557, 573; 250/342, 221, 353

[56] References Cited

U.S. PATENT DOCUMENTS

| | | | |
|---|---|---|---|
| 4,346,427 | 8/1982 | Blissett et al. | 340/573 |
| 4,364,030 | 12/1982 | Rossin | 340/567 |
| 4,851,681 | 7/1989 | DePauli | 250/338.1 |
| 4,943,712 | 7/1990 | Wilder | 340/567 |
| 5,077,549 | 12/1991 | Hershkovitz et al. | 340/567 |
| 5,309,147 | 5/1994 | Lee et al. | 340/567 |
| 5,486,810 | 1/1996 | Schwarz | 340/567 |
| 5,670,943 | 9/1997 | Dipoala et al. | 340/567 |

*Primary Examiner*—Nina Tong
*Attorney, Agent, or Firm*—Burns, Doane, Swecker & Mathis, L.L.P.

[57] ABSTRACT

A simplified analog passive infrared motion detection circuit operates using only four operational amplifiers. A first amplifier is used as part of a bandpass amplifier circuit, a second is used in an inverter circuit, a third is used in an integrator circuit and a fourth is used in a threshold comparator circuit for generating an alarm output signal. The circuit is built using a single quad op amp IC package and is economical to manufacture. The third op amp can alternatively be used as a passive infrared sensor preamplifier and a transistor can be used in the integrator circuit, so that a regulated power supply for the circuit is not needed.

4 Claims, 2 Drawing Sheets

PASSIVE INFRARED MOTION DETECTION CIRCUIT HAVING FOUR COMPARATORS

FIELD OF THE INVENTION

The present invention relates to a passive infrared motion detection circuit.

BACKGROUND OF THE INVENTION

In security systems, passive infrared motion detectors are commonly used to detect intrusion. An example is U.S. Pat. No. 5,077,549 to Hershkovitz et al. co-invented by the present Applicant. Such circuits process a pyrroelectric sensor output signal to generate an alarm signal. In the conventional analog circuits, many active circuit components are used to provide reliable and efficient signal processing.

In the case of Hershkovitz et al., the circuit comprises a band pass amplifier, an absolute value amplifier, a voltage controlled pulse generator, an integrator, a threshold comparator, a timer, logic gates, etc. The number of active elements, such as comparators and logic gates is typically six or more. The band pass amplifier typically has two amplifiers, and the absolute value amplifier typically has a minimum of two amplifiers.

In commercially available high-volume IC components, there is presently available at a low cost IC packages of four comparators/amplifiers (referred to a quad op amp IC's). Packages of five or six op amps are less competitively priced, and it is often desirable to use separate IC's, such as two quads or a quad and a dual op amp to provide enough comparators/amplifiers for the motion detection circuit. Of course, installing an additional component on a circuit board of a motion detector adds to the cost of manufacture.

SUMMARY OF THE INVENTION

It is therefore an object of the present invention to provide an inexpensive analog passive infrared motion detection circuit using only four comparators.

According a first broad aspect of the invention, there is provided a passive infrared motion detection circuit including a single package integrated circuit having first, second, third and fourth comparator amplifiers, a passive element feedback circuit connecting an output of either the first comparator or the second comparator to an input of the first comparator, the first comparator also having as input a passive infrared sensor output signal and being arranged as a differential amplifier with a substantially flat frequency response in a range of 0.1 to 10 Hz. The sensor is connected to a regulated DC power supply. The circuit further includes a passive element unity gain inverter circuit means associated with the second comparator to provide an inverting amplifier with a gain substantially of unity, a passive element integration circuit means associated with the third comparator to provide an integrator, a first diode connecting an output of the second comparator to the integrator, a second diode connecting an output of the second comparator to the integrator, the integrator receiving the sensor signal amplified and rectified, and a threshold detection circuit means associated with the fourth comparator, the fourth comparator having an input connected to an output of the third comparator and an output providing an alarm signal.

According a second broad aspect of the invention, there is provided a passive infrared motion detection circuit comprising: a single package integrated circuit having first, second, third and fourth comparator amplifiers; a passive element feedback circuit connecting an output of one of the first and the second comparators to an input of the first comparator, the first comparator being arranged as an amplifier with a substantially flat frequency response in a range of 0.1 to 10 Hz, the sensor being powered by an unregulated DC power supply; passive element unity gain inverter circuit means associated with the second comparator to provide an inverting amplifier with a gain substantially of unity; a sensor signal preamplifier circuit means associated with the third comparator for amplifying an AC and a DC component of an output signal from a passive infrared sensor and producing an output signal connected to an input of the first comparator; a transistor having a gate input and an output; an integrating capacitor circuit means connected to the transistor output; a first diode connecting an output of the second comparator to the transistor gate input; a second diode connecting an output of the second comparator to the transistor gate input, the integrating capacitor circuit means receiving the sensor signal as amplified and rectified; and threshold detection circuit means associated with the fourth comparator, the fourth comparator having an input connected to the integrating capacitor circuit means and an output providing an alarm signal. According to the second aspect of the invention, the whole circuit can be powered by an unregulated power supply, since the third comparator is used in a preamplifier circuit which eliminates any adverse effects of an unregulated power supply on the sensor.

BRIEF DESCRIPTION OF THE DRAWINGS

The invention will be better understood by way of the following description of a preferred embodiment of the invention with reference to the appended drawings, in which.

DETAILED DESCRIPTION OF THE PREFERRED EMBODIMENTS

Figure 1:
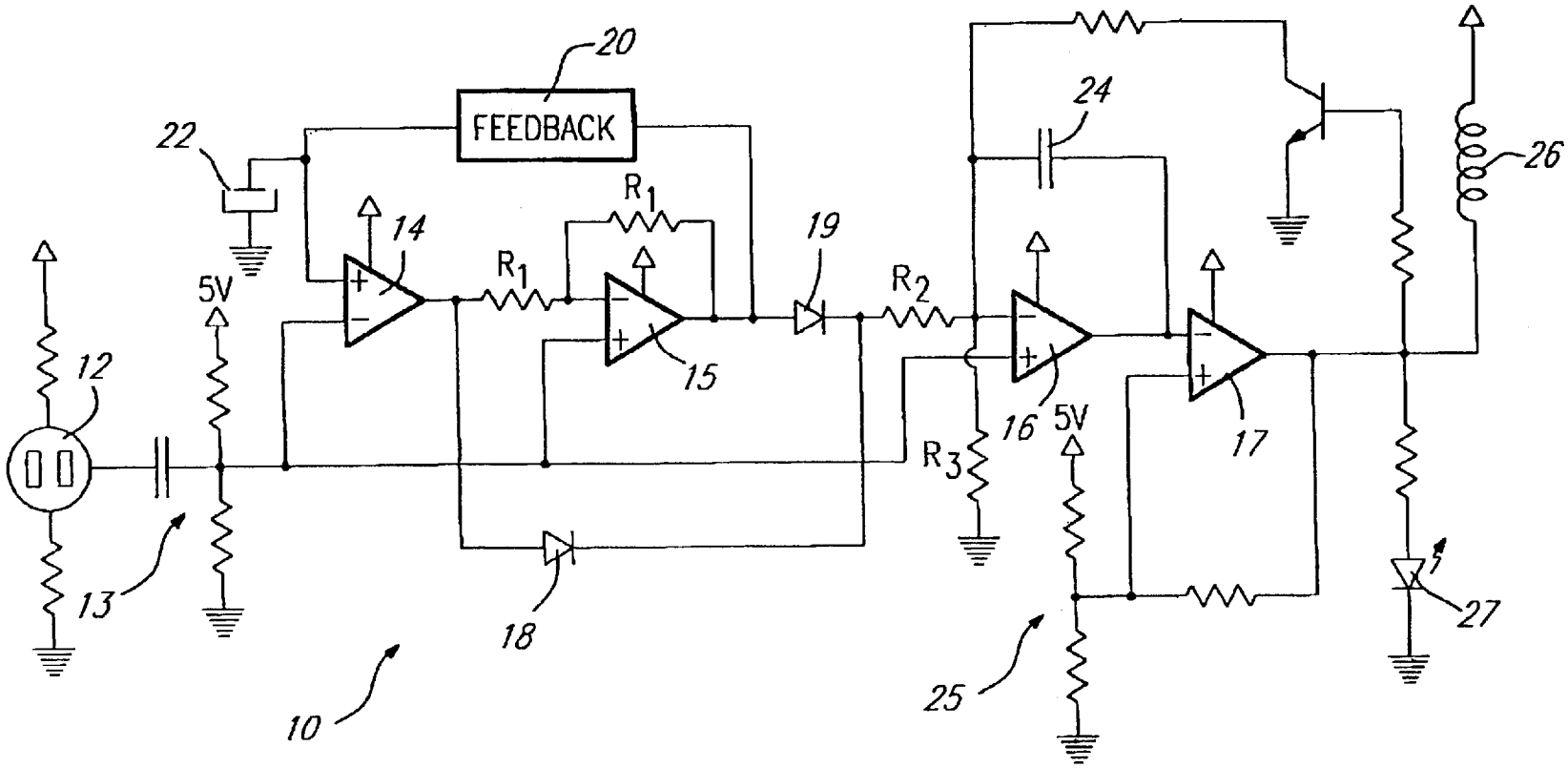
FIG. 1 is a schematic diagram of the circuit according to the first preferred embodiment.

The passive infrared motion detection circuit 10 in the first preferred embodiment includes four op amp comparators 14 through 17 provided in a single IC package (the single package is not shown in the schematic diagram). A pyrroelectric sensor 12, as is known in the art, generates a voltage in response to changes in the amount of infrared radiation impinging on it and provides a varying signal in response to a person or other infrared radiation emitting object moving through an area covered by a lens focusing the infrared light on to the sensor 12, in a manner well known in the art. A capacitor and voltage divider circuit 13 is provided for allowing an AC component of the sensor signal raised to a predetermined DC bias to pass through to the comparators and, in particular, to comparator 14. The bias voltage is in the middle of the voltage range, i.e. 2.5 V. The capacitor in circuit 13 may be 1 $\mu$F and the voltage divider may provide a DC bias level of 1 or 2 volts. In the first preferred embodiment, the sensor is connected to the power supply which is regulated, eg. 5 Vdc. The power supply (not shown) powers all other powered circuit elements.

The amplifier or comparator 14 provides a gain of approximately 5,000 and is arranged as a differential amplifier. The output of comparator 14 passes through diode 18 so that the positive half of the output signal of comparator 14 is connected to the input of the integrator circuit. Comparator 15 is arranged as an inverting amplifier with the resistor values $R_1$ being equal, and for example, having a value of 100 kΩ.

The inverted signal output from comparator 15 passes through diode 19 to the input of the integrator. The feedback circuit 20 preferably includes a temperature compensation circuit which increases the gain of amplifier 14 as the ambient temperature increases. When the ambient temperature increases, the contrast between the ambient level of infrared radiation and the level of infrared radiation emitted by moving objects such as people decreases, and therefore, it is necessary to increase the sensitivity of the circuit as the ambient temperature increases. The feedback circuit 20 and the value of the capacitor 22 are chosen to provide an AC gain of approximately 5,000 with a substantially flat frequency response in the frequency range of 0.1–10 Hz. The DC gain is unity The integrator circuit includes an input terminal resistance $R_2$, comparator 16 and an integrating capacitor 24 The integrating capacitor may have a value of about 3.3 μF. In order to prevent false alarms due to accumulation of noise signals over a longer time frame, the voltage across capacitor 24 may be slowly discharged to ground by a resistor $R_3$ having a large value. Comparator 17 may have its positive terminal connected to the DC bias voltage connected to comparators 14, 15 and 16, or as shown, a voltage reference circuit 25 may be provided for providing a suitable reference voltage. When the output of the integrator exceeds the reference voltage, current passing through coil 26 from the output of comparator 17 opens a relay switch to generate the output alarm signal. The voltage reference circuit 25 controls the timing of switching to "on" of the alarm signal, and the comparator 17 with the circuit 25 operate as a Schmidt trigger. In parallel to the relay coil 26, an LED 27 is provided for a visual signal.

Figure 2:
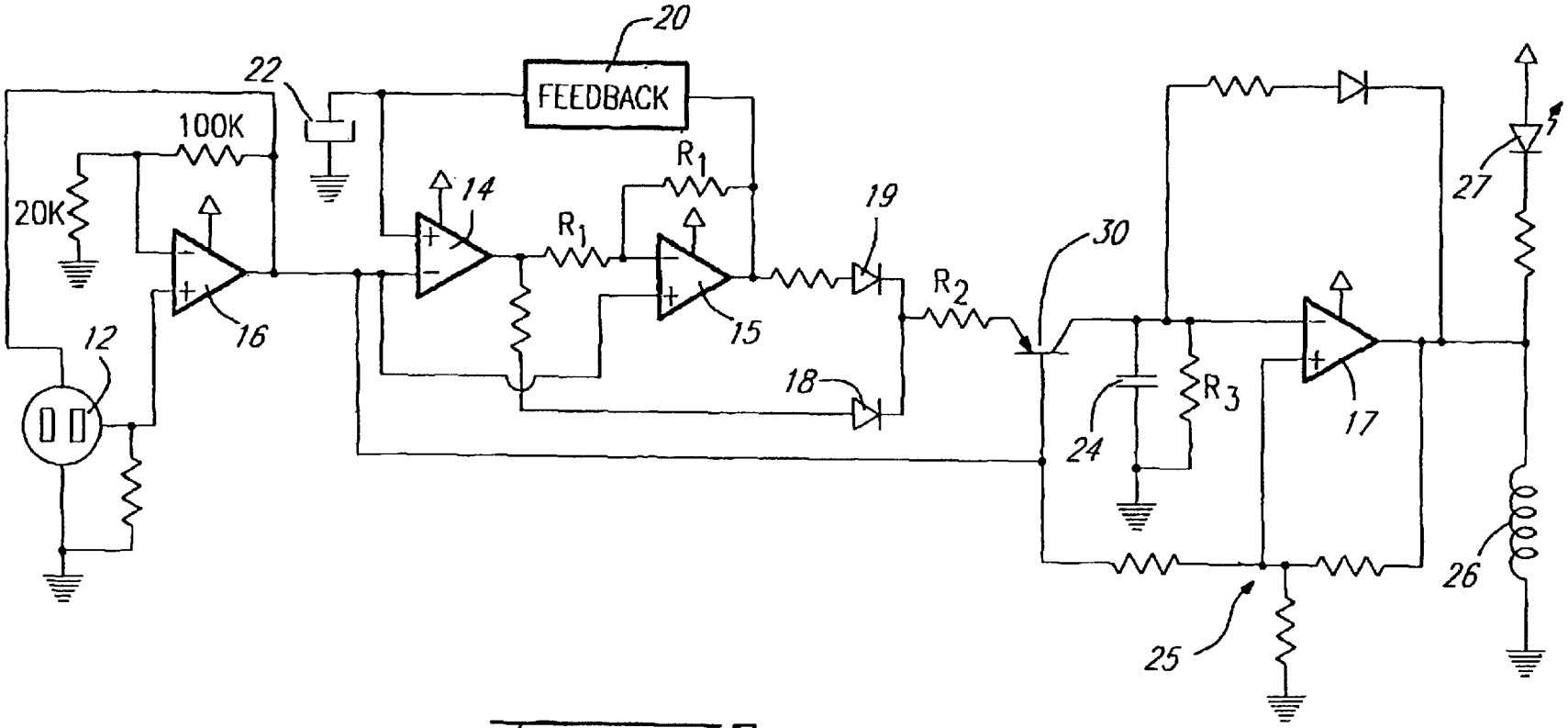
FIG. 2 is a schematic diagram of the circuit according to the second preferred embodiment.

As is illustrated in FIG. 2, a different motion detection alarm circuit configuration using four op amp comparators is provided according to the second preferred embodiment. The comparator 16 in FIG. 2 is not used for integration, but rather it is used as an AC and DC pre-amplifier with a gain of 5. Comparator 16 has its positive input connected to an output from sensor 12. The DC voltage supplied to the components in the second preferred embodiment is 12V, and no voltage regulator is used. The sensor is connected to the voltage at the output of comparator 16. The power supply voltage may be in the range of about 9V to 16V. The transistor 30 thus allows the amplified and rectified output signal to be transmitted to the integrating capacitor 24 at a relatively higher voltage, such that the 1 μF capacitor 24 can be used to integrates the sensor output signal. When the integrated voltage on capacitor 24 exceeds the threshold voltage set by voltage divider circuit 25, the output from comparator 17 causes the solenoid coil 26 and LED 27 to signal the alarm.

Although the invention has been described above with reference to a preferred embodiment, it is to be understood that the above description is intended merely to illustrate the invention and not to limit the scope of the invention as defined in the appended claims.

What is claimed is:

1. A passive infrared motion detection circuit comprising:

a single package integrated circuit having first, second, third and fourth comparator amplifiers;

a passive element feedback circuit connecting an output of one of said first and said second comparators to an input of said first comparator, said first comparator also having as input a passive infrared sensor output signal and being arranged as a differential amplifier with a substantially flat frequency response in a range of 0.1 to 10 Hz, said sensor being connected to a regulated supply voltage;

passive element unity gain inverter circuit means associated with said second comparator to provide an inverting amplifier with a gain substantially of unity;

passive element integration circuit means associated with said third comparator to provide an integrator;

a first diode connecting an output of said second comparator to said integrator;

a second diode connecting an output of said second comparator to said integrator, said integrator receiving said sensor signal amplified and rectified; and threshold detection circuit means associated with said fourth comparator, said fourth comparator having an input connected to an output of said third comparator and an output providing an alarm signal.

2. The passive infrared motion detection circuit defined in claim 1, wherein said output of said second comparator is connected to said passive element feedback circuit.

3. A passive infrared motion detection circuit comprising:

a single package integrated circuit having first, second, third and fourth comparator amplifiers;

a passive element feedback circuit connecting an output of one of said first and said second comparators to an input of said first comparator, said first comparator being arranged as an amplifier with a substantially flat frequency response in a range of 0.1 to 10 Hz;

passive element unity gain inverter circuit means associated with said second comparator to provide an inverting amplifier with a gain substantially of unity;

a sensor signal preamplifier circuit means associated with said third comparator for amplifying an AC and a DC component of an output signal from a passive infrared sensor and producing an output signal connected to an input of said first comparator, said sensor being powered by an unregulated DC power supply;

a transistor having a gate input and an output;

an integrating capacitor circuit means connected to said transistor output;

a first diode connecting an output of said second comparator to said transistor gate input;

a second diode connecting an output of said second comparator to said transistor gate input, said integrating capacitor circuit means receiving said sensor signal amplified and rectified; and threshold detection circuit means associated with said fourth comparator, said fourth comparator having an input connected to said integrating capacitor circuit means and an output providing an alarm signal.

4. The passive infrared motion detection circuit defined in claim 3, wherein said transistor and said single package are powered by said unregulated DC power supply having a supply voltage substantially in the range of 9V to 16V.

* * * * *